United States Patent [19]

Wilson et al.

[11] 4,248,111

[45] Feb. 3, 1981

[54] PUNCH GUIDE ASSEMBLY

[75] Inventors: Kenneth J. Wilson, Roseville; Ronald G. Rosene, Anoka, both of Minn.

[73] Assignee: Wilson Tool Company, White Bear Lake, Minn.

[21] Appl. No.: 57,967

[22] Filed: Jul. 16, 1979

[51] Int. Cl.[3] ..... B26D 7/06; B26F 1/14

[52] U.S. Cl. ..... 83/140; 83/698

[58] Field of Search ..... 83/140, 141, 142, 143, 83/145, 146, 552, 588, 698, 138, 139

[56] References Cited

U.S. PATENT DOCUMENTS

| | | | |
|---|---|---|---|
| 2,380,343 | 7/1945 | Stellin | 83/698 X |
| 3,079,824 | 3/1963 | Schott | 83/140 |
| 3,296,905 | 1/1967 | Killaly | 83/140 |
| 3,871,254 | 3/1975 | Whistler et al. | 83/140 |
| 4,085,639 | 4/1978 | Marconi | 83/698 X |
| 4,092,888 | 6/1978 | Wilson | 83/143 X |

FOREIGN PATENT DOCUMENTS

| | | | |
|---|---|---|---|
| 883611 | 10/1971 | Canada | 83/698 |
| 1251843 | 11/1971 | United Kingdom | 83/140 |

*Primary Examiner*—Frank T. Yost
*Assistant Examiner*—Robert P. Olszewski
*Attorney, Agent, or Firm*—Steven G. Parmelee

[57] ABSTRACT

A punch guide assembly having a removable stripper plate. The assembly includes clip tabs having stripper plate holding tabs formed on ends thereof for disposition through a hole provided in the punch guide and for reception within an appropriate recess in the stripper plate for retaining the stripper plate. The assembly also includes a grooved track disposed about the punch guide and a tool for insertion therein to urge the clip tabs outwardly of the punch guide, to facilitate insertion and removal of the stripper plate.

5 Claims, 9 Drawing Figures

PUNCH GUIDE ASSEMBLY

TECHNICAL FIELD

This invention relates generally to punch guide assemblies such as those usable with multiple station turret punch machines.

BACKGROUND ART

Multiple station turret punch machines such as the Amada Lyla Series Model 50-50-72 can provide up to 72 different punch stations for use in conjunction with a like number of opposing die surfaces. In such a machine, each punch station includes a punch assembly and a punch guide. Even with the flexibility afforded by a 72-station machine, however, the operator may wish to change some or all of the punch and die combinations from time to time. For instance, the operator may wish to utilize a different punch tip shape or one of a different size. It is desirable to minimize the time required to so change the punch and die components, and thereby reduce down time for the punch machine.

In the punching operation, after the punch tip enters the worksheet surface, the edge of the cut surface will tend to follow the punch tip as it retracts. As a result, "stripping" occurs; that is, the edges around the punched hole will bear outwardly and necessitate further time consuming finishing operations.

To prevent stripping, the punch guide may be provided with a stripper plate. A stripper plate is a hardened plate having an opening such that a punch tip will fit snugly therethrough, yet be able to axially move freely through the opening. In use, the punch guide is oriented with the stripper plate flush against the worksheet surface. Then, when the punch tip retracts from the worksheet, the edges of the worksheet around the punch hole will be prevented by the stripper plate from following the retracting punch tip.

One such punch guide-stripper plate configuration incorporates the stripper plate as an integral part of the punch guide itself. Since the size and shape of the stripper plate hole must coincide closely with the punch tip, however, each such punch guide may only be used with one matching punch assembly. Consequently, interchanging punch and die combinations may be inconvenient, since the operator must change not only the die and the punch assembly, but the punch guide assembly as well.

Another configuration uses flattened metal clips or the like to retain a removable stripper plate at the end of a punch guide. This allows the use of a number of different punch tips with each guide, since only the stripper plate need be changed for each new punch tip. These spring clip structures, however, have not provided completely satisfactory. Often, the worksheet surface will have a thin coating of oil or other fluid. When the stripper plate meets the worksheet surface, a suction may be created. When this occurs, the stripper plate may be pulled out of place and damage may result to the worksheet and to the stripper plate. Down time may also become a problem. These clips also tend to weaken with usage, aggravating the above-noted problems. Another configuration is shown in U.S. Pat. No. 4,092,888 which depicts a punch guide assembly using a resilient retaining ring to hold a removable stripper plate in place.

DISCLOSURE OF INVENTION

The instant invention is directed towards a punch guide assembly having opposing clip tabs for securely retaining a removable stripper plate at the end of a punch guide. The clip tabs may be made of lengths of a resilient wire material and are attached to the punch guide and secured in a recessed position parallel to the longitudinal axis of the punch guide. The wire lengths may have an unattached end bent at an appropriate angle, such as 90°, to define a stripper plate holding tab. A stripper plate having one or more tab-receiving recesses is juxtaposed between opposing holding tabs, and the holding tabs may be resiliently urged within the tab recess, to thereby hold the stripper plate in place. To facilitate unobstructed insertion and removal of the stripper plate, that is, the placement and displacement of the stripper plate without encountering any resilient or nonresilient obstacles, the guide may include a grooved track circumferentially disposed thereabout proximal the stripper plate end of the guide such that an appropriate tool may be disposed therein to urge the clip tabs outwardly from the guide and thereby remove the holding tabs from within the stripper plate tab recess. The stripper plate may then be easily removed and a new one inserted.

BRIEF DESCRIPTION OF DRAWINGS

The advantages of the instant invention will become more obvious upon reference to the following detailed description, and particularly when considered in view of the appended drawings, wherein.

BEST MODE FOR CARRYING OUT THE INVENTION

Figure 1:
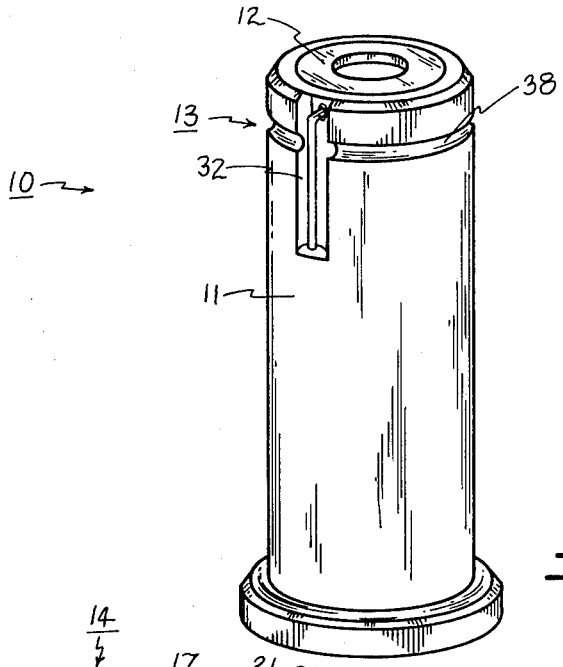
FIG. 1 is a perspective view of an embodiment of the invention.

Referring now to FIG. 1, the apparatus of the invention is denoted generally by the numeral 10. The apparatus (10) includes generally sleeve means, stripper plate means, stripper plate retaining means and stripper plate insertion and removal means.

Figure 2:
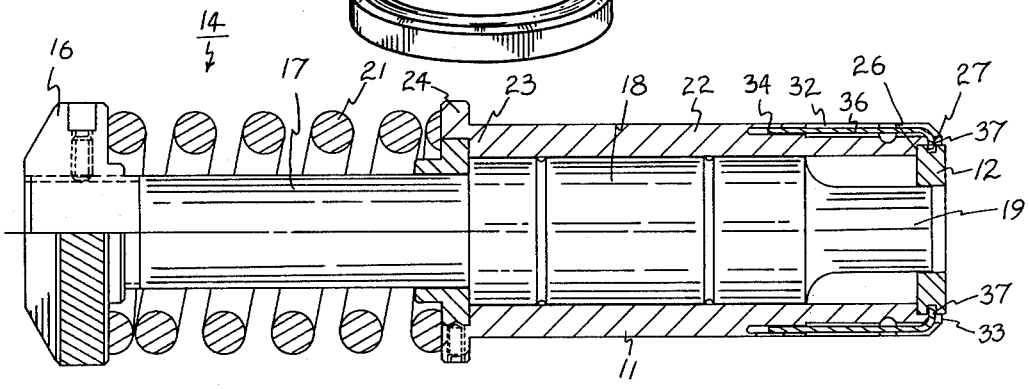
FIG. 2 is a side elevational view in partial cross-section of the embodiment of the invention shown in FIG. 1, in conjunction with a punch assembly.

With reference to FIG. 2, the apparatus (10) is shown in operative conjunction with a punch assembly denoted generally by the numeral 14. To facilitate a more complete understanding of the invention, a brief description of the punch assembly (14) will be provided. The punch assembly (14) is of a type generally known in the prior art, and includes a punch head (16), an upper shank (17), a lower shank (18), and a punch tip (19). The punch assembly (14) also includes a spring (21) for urging the punch tip (19) towards a retracted position as depicted.

With continued reference to FIG. 2, the sleeve means of the invention are typified in this embodiment by a sleeve (11) formed generally of a guide tube (22) having two open ends. One end (23) of the sleeve (11) includes a spring support collar (24) for supporting the punch assembly spring (21) described above. It should be observed that as the punch head (16) becomes urged towards this collar (24), the punch tip (19) will extend axially outward from the sleeve (11). Upon removing pressure from the punch head (16), the spring (21) will urge the punch head (16) away from the sleeve (11), and cause the punch tip (19) to restract within the sleeve (11). The end of the sleeve opposite the spring support collar (24) includes an annularly shaped shoulder (26) formed on the interior thereof for receiving and supporting a stripper plate (12). The sleeve (11) also includes two holding tab holes (27) formed radially therethrough, the purpose of which will be described more fully below.

Figure 3:
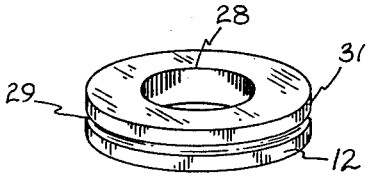
FIG. 3 is a perspective view of an embodiment of a stripper plate.
Figure 4:
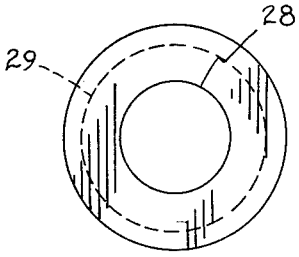
FIG. 4 is a top plan view of the stripper plate shown in FIG. 3.
Figure 5:
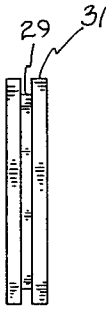
FIG. 5 is a side elevational view of the stripper plate shown in FIG. 3.

Referring now to FIGS. 3, 4 and 5, the stripper plate means are typified in this embodiment as a disc-shaped stripper plate (12) made of a hardened substance such as steel. The stripper plate (12) includes a circularly-shaped opening (28) axially disposed therethrough for the reception of a punch tip (19). To accommodate punch tips of differing configurations and sizes, the shape and size of the opening (28) through the stripper plate (12) may be altered accordingly. The stripper plate (12) also includes a groove (29) disclosed circumferentially about its side edge (31). This groove (29) provides a recess for receiving the holding tabs that are described in detail further below.

Figure 8:
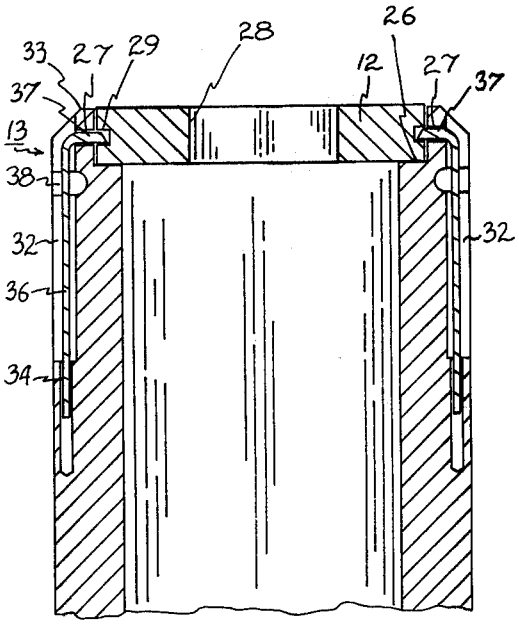
FIG. 8 is an enlarged side elevational view in cross-section of a stripper plate as secured according to the invention.
Figure 9:
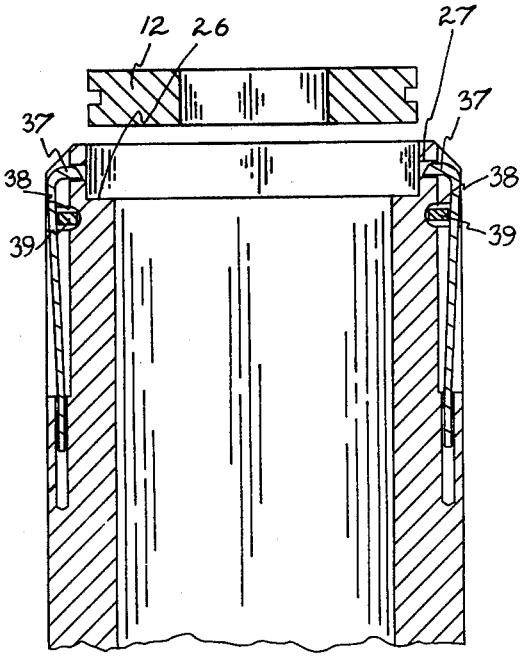
FIG. 9 is an enlarged side elevational view in cross-section of the stripper plate as removed according to the invention.

Referring now to FIGS. 8 and 9, the stripper plate retaining means are typified in this embodiment by a clip tab assembly (13). The clip tab assembly (13) includes two narrow troughs (32) formed in the sleeve (11) and disposed opposite one another near the punch tip end (33) of the sleeve (11). These troughs (32) each include a clip tab hole (34) for receiving a clip tab (36). The clip tabs (36) may be formed of a resilient, springy wire material or the like and may be snugly held (e.g., press-fitted) within at least a part of the clip tab hole (34), such that the clip tab (36) may not be easily removed therefrom. The clip tabs (36) could also be held by some suitable adhesive or by a set screw or the like. The unattached ends of the clip tabs (36) are bent about 90° towards the axis of the sleeve (11) to define stripper plate holding tabs (37). It may be noted that in this embodiment, the stripper plate holding tabs (37) are substantially colinear with one another. These holding tabs (37) are insertable within and freely movable through the holding tab holes (27) described above.

The operation of the apparatus (10) will now be described. As shown in FIGS. 8 and 9, the stripper plate (12) may be disposed within the punch tip end (33) of the sleeve (11) flush against the shoulder (26). When so disposed, the groove (29) in the stripper plate becomes aligned with the holding tab holes (27), thereby forming a number of holding tab pathways. When the clip tabs (36) are normally positioned (FIGS. 2 and 8), the holding tabs (37) are located within the stripper plate groove (29) such that the stripper plate (12) may not be removed. When the clip tabs (36) are urged outwardly and away from the sleeve (11) (as shown in (FIG. 9), the holding tabs (37) are retracted away from the stripper plate groove (29) so that the stripper plate (12) may be easily removed without obstruction.

To facilitate the removal and insertion of the stripper plate (12), stripper plate insertion and removal means are provided, as typified in this embodiment by a grooved track (38) circumferentially disposed about the exterior of the sleeve (11) proximal the punch tip end (33) thereof (as perhaps best illustrated in FIG. 1). By providing such a grooved track (38), an appropriate tool (39) may be inserted therein between the sleeve (11) and the clip tab (36), such that the clip tab (32) becomes urged outwardly of the sleeve (11) (as shown in FIG. 9).

Figure 6:
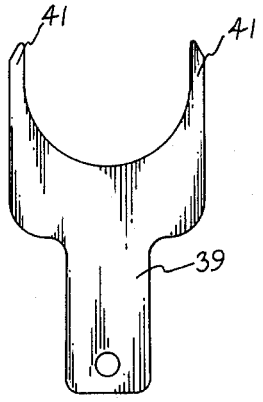
FIG. 6 is a top plan view of a tool useable in removing and inserting stripper plates from the embodiment of the invention shown in FIGS. 1, 2, 8 and 9.
Figure 7:
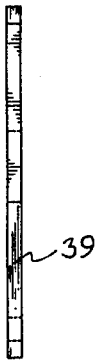
FIG. 7 is a side elevational view of the tool shown in FIG. 6.

A tool (39) for complementary use with such a grooved track (38) is depicted in FIGS. 6 and 7. The tool (39) includes two generally parallel forks (41) having tapered ends and a handle mounting the forks and having an arcuate surface between those forks (41), the forks being so oriented as to permit them to be easily inserted along the grooved track (38) simultaneously between the sleeve (11) and the clip tabs (36), the distance between the forks closely approximating the diameter of the grooved track (38).

The complete operation of the punch guide assembly (10) should now be evident. The sleeve (11) may be mounted in an appropriate multiple station turret machine or other suitable punch machine. The operator may then choose a punch assembly (14) having a lower shank (18) suitably disposable within the sleeve (11) and having a punch tip (19) of the desired size and configuration. The operator then chooses a stripper plate (12) complementary to that punch tip (19) and installs it in the sleeve (11) without obstruction by inserting the tool (39) into the grooved track (38) to urge the clip tabs (36) outwardly of the sleeve (11) towards a non-latching position. Upon inserting the stripper plate (12), the tool (39) is removed, and the resiliency of the clip tabs (36) urges the holding tabs (37) to slide back along the holding tab pathway and into position within the stripper plate groove (39) towards a latching position. So positioned, the stripper plate (12) may not be removed, and will remain in place during operation of the punching apparatus. In particular, not even suction caused by the presence of a fluid on the surface of the worksheet material will dislodge the stripper plate (12). The stripper plate (12) may easily be removed without obstruction by simply unlatching the holding tabs (37) by insertion of tool (39), thus reversing the above procedure.

Many changes to the disclosed embodiment will be readily apparent to those skilled in the art. For instance, more than two clip tabs (36) may be provided. The holding tabs (37) might be inclined at an angle other than 90°, although this general configuration appears to provide the best results. Also, rather than having a groove (29) disposed about its circumference, the stripper plate (12) might have two or more holes or radial grooves or the like for receiving the holding tabs (37).

Therefore, while I have described the best mode known for carrying out the invention, it will be understood that various changes, adaptations, and modifications may be made therein without departing from the spirit of the invention and the scope of the appended claims.

We claim:

1. A punch guide assembly usable with a punch assembly and comprising:

(a) sleeve means for receiving at least part of a punch assembly, including a tube having at least one open end and further including a plurality of holes disposed through said tube proximal said open end;

(b) stripper plate means receivable within said open end for substantially preventing stripping during operation of the punch assembly, the stripper plate means including a recess disposed thereon that is alignable with at least some of said holes when said stripper plate means is received within said open end, thereby forming a plurality of aligned hole and recesss combinations;

(c) clip tab means including a plurality of holding tabs removably insertable into said aligned hole and recess combinations and being operable to releasably restrain the removal of said stripper plate means from the sleeve means; and (d) said sleeve means further includes grooved track means disposed circumferentially about said tube proximal said open end, and providing access to said clip tabs to permit said clip tabs to be urged outwardly to withdraw said holding tabs from the stripper plate means recess, whereby the stripper plate means may be easily removed from the sleeve means.

2. The punch guide assembly of claim 1 wherein said clip tab means includes:

(a) a plurality of clip tabs equal to the number of said holding tabs and having one end thereof attached to said tube; and (b) said holding tabs are disposed at about 90° angles to said clip tabs and are attached to the unattached ends thereof.

3. The punch guide assembly of claim 2 wherein the number of holding tabs is two.

4. The punch guide assembly of claim 3 wherein said holding tabs are aligned substantially collinear to each other.

5. The punch guide assembly comprising:

(a) a hollow sleeve having an open first end and further including:

(i) first and second externally accessible recesses being disposed substantially opposite one another;

(ii) a first hole disposed through said sleeve within said first recess;

(iii) a second hole disposed through said sleeve within said second recess, and being further located substantially opposite said first hole; and (iv) an exteriorly accessible grooved track disposed circumferentially thereabout proximal said first end;

(b) a stripper plate receivable within said first end and having a side edge, said edge including a groove disposed therein such that when said stripper plate is received within said first end, said first and second holes are alignable with said groove; and (c) clip tab means including;

(i) a resilient elongated first member attached at one end to said sleeve and extending in the first recess towards the open end of said sleeve such that said grooved track is located between said attached end and said open end;

(ii) a resilient elongated second member attached at one end to said sleeve and extending in the second recess toward the open end of said sleeve such that said grooved track is located between said attached end and said open end;

(iii) a first holding tab attached to said first member and being disposed at substantially a 90° angle thereto, said first holding tab being removably insertable within said first hole and within at least a part of said stripper plate groove; and (iv) a second holding tab attached to said second member and being disposed at substantially a 90° angle thereto, said second holding tab being removably insertable within said second hole and within at least a part of said stripper plate groove.

* * * * *